US005332220A

United States Patent [19]

Leavy

[11] Patent Number: 5,332,220

[45] Date of Patent: Jul. 26, 1994

[54] JIGSAW PUZZLE PIECE ORGANIZER

[76] Inventor: William A. Leavy, 12506 Madeley La., Bowie, Md. 20715

[21] Appl. No.: 73,034

[22] Filed: Jun. 8, 1993

[51] Int. Cl.[5] ..... A63F 9/00

[52] U.S. Cl. ..... 273/148 R; 273/157 R

[58] Field of Search ..... 273/157 R, 148 R, 272

[56] References Cited

U.S. PATENT DOCUMENTS

| | | | |
|---|---|---|---|
| 3,792,668 | 2/1974 | Ward | 108/69 |
| 3,884,476 | 5/1975 | Sanders | 273/157 R |
| 4,026,559 | 5/1977 | Carlton | 273/157 R |
| 4,111,425 | 9/1978 | Lathrop | 273/157 R |
| 4,302,013 | 11/1981 | Kavis | 273/157 R |
| 4,436,307 | 3/1984 | Caldwell | 273/157 R |
| 4,865,325 | 9/1989 | Stolz | 273/157 R |
| 4,984,798 | 1/1991 | Silberstein | 273/157 R |
| 5,100,150 | 3/1992 | Larman | 273/272 |

*Primary Examiner*—Benjamin H. Layno

*Attorney, Agent, or Firm*—Brady, O'Boyle & Gates

[57] ABSTRACT

A jigsaw puzzle piece organizer wherein a plurality of trays are provided for holding a plurality of groups of puzzle pieces according to the color and configuration of the puzzle pieces. Interconnected empty trays can be arranged in a compact stack for storage, or in an interconnected stack wherein there is a clearance between adjacent trays containing puzzle pieces for providing temporary storage for the puzzle pieces during the assembly of the puzzle to completion.

6 Claims, 7 Drawing Sheets

JIGSAW PUZZLE PIECE ORGANIZER

BACKGROUND OF THE INVENTION

Assembling a jigsaw puzzle involves storing and manipulating many small puzzle pieces, often in a small area where it is difficult to spread the pieces out, so that they can be easily inspected and located. It can be frustrating to have many puzzle pieces in the way while searching for a particular piece, or often finding one, to have the location where it fits in the final picture be covered with other loose pieces, which are also liable to be lost, or mistakenly thrown away.

While various jigsaw puzzle support and storage boards or trays have been proposed to facilitate the assembly of the various pieces into the complete puzzle picture, they have been characterized as being large and cumbersome thereby not offering a practical solution to the problem of storing puzzle pieces in a small space without compromising accessibility.

To overcome the disadvantages experienced with prior puzzle support and storage boards, the organizer of the present invention has been devised for holding the loose puzzle pieces and is constructed and arranged to be small enough to fit inside a standard size puzzle box, approximately 9" by 12", and promotes the organization of the loose puzzle pieces into rows and columns based on color and/or geometry, thereby facilitating the assembly of a jigsaw puzzle.

SUMMARY OF THE INVENTION

The jigsaw puzzle piece organizer of the present invention comprises, essentially, a plurality of stackable trays adapted to contain a plurality of loose puzzle pieces. Each tray contains a grid indicia on its supporting surface to facilitate the positioning of the various puzzle pieces in columns and rows, and according to color and/or shape on a respective tray.

Each tray has a plurality of posts and holes which cooperate with the posts and holes in the next adjacent tray in the stack, whereby the trays can be oriented to provide ample clearance between the trays containing puzzle pieces, when stacked for temporary storage, or when the trays are empty of puzzle pieces they can be further oriented to provide a compact interconnected stack for storage.

DESCRIPTION OF THE PREFERRED EMBODIMENT

Figure 4:
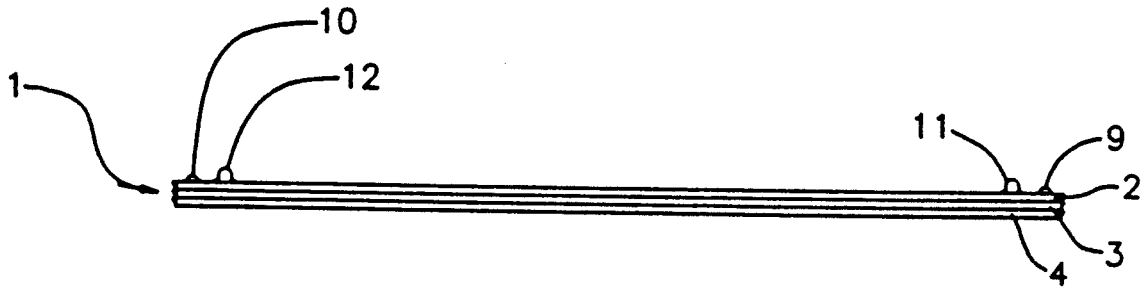
FIG. 4 is an end elevational view of the organizer of the present invention showing a plurality of empty trays oriented in a compact interconnected stack for storage.
Figure 5:
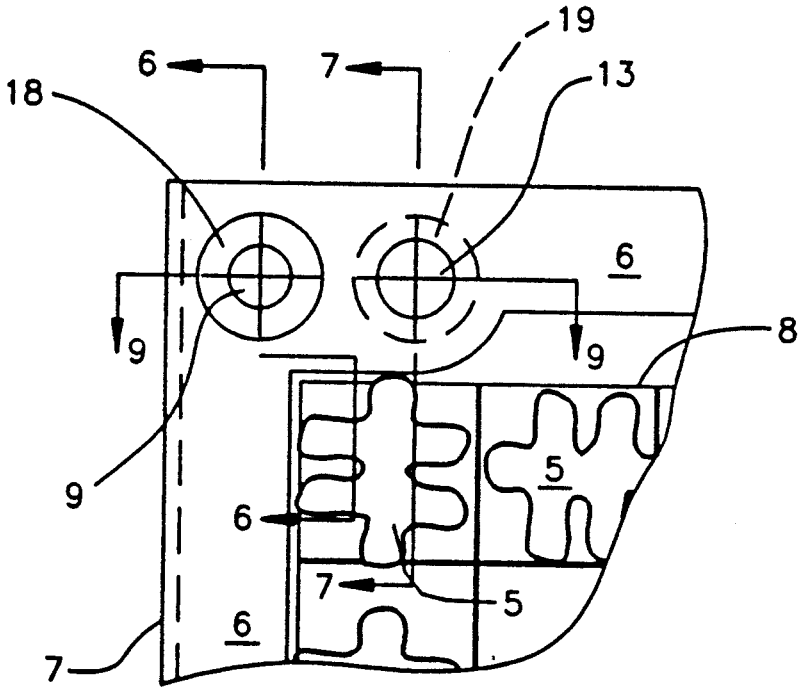
FIG. 5 is an enlarged, fragmentary view of the corner of the tray outlined in dot-dash line in FIG. 1.
Figure 11:
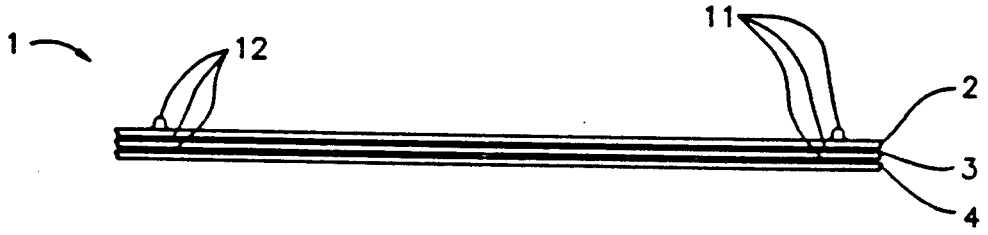
FIG. 11 is an end elevational view of the organizer showing a plurality of empty stacked trays, each tray being oriented to provide a clearance between the trays.
Figure 14:
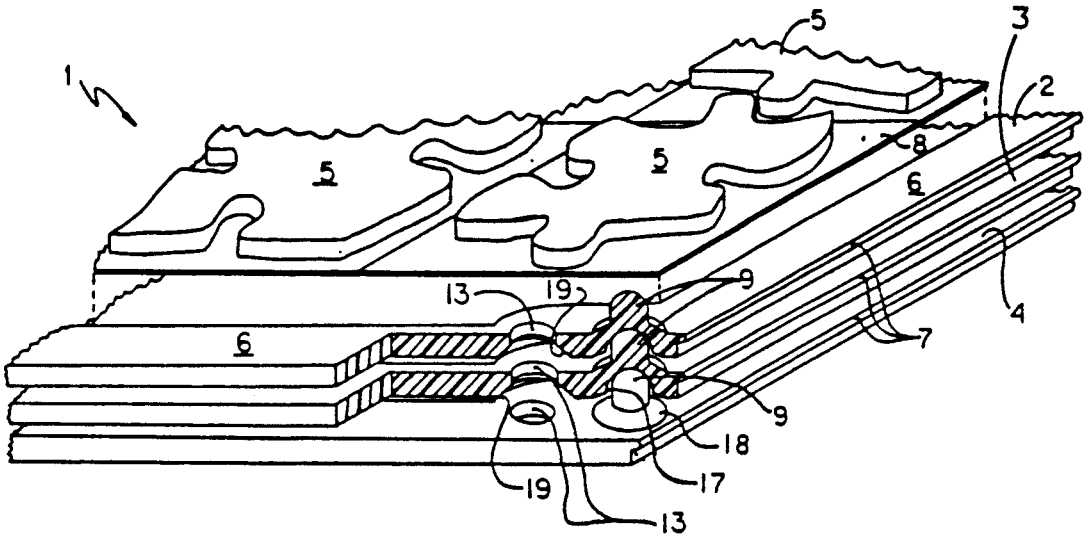
FIG. 14 is a fragmentary perspective view, partly in section showing a corner of the organizer with the trays oriented to provide the spaced stack as shown in FIGS. 11 and 12.
Figure 12:
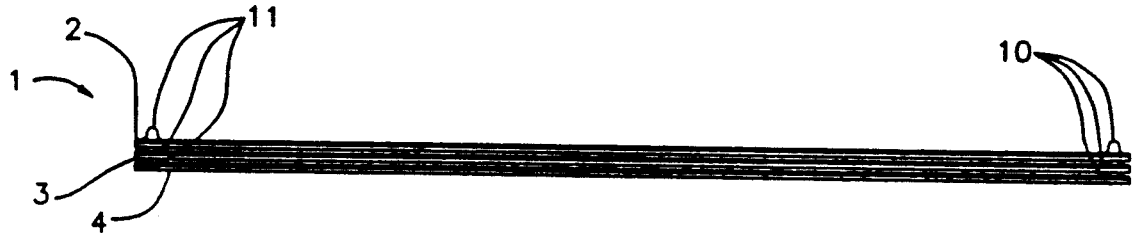
FIG. 12 is a side elevational view of the organizer shown in FIG. 11.
Figure 15:
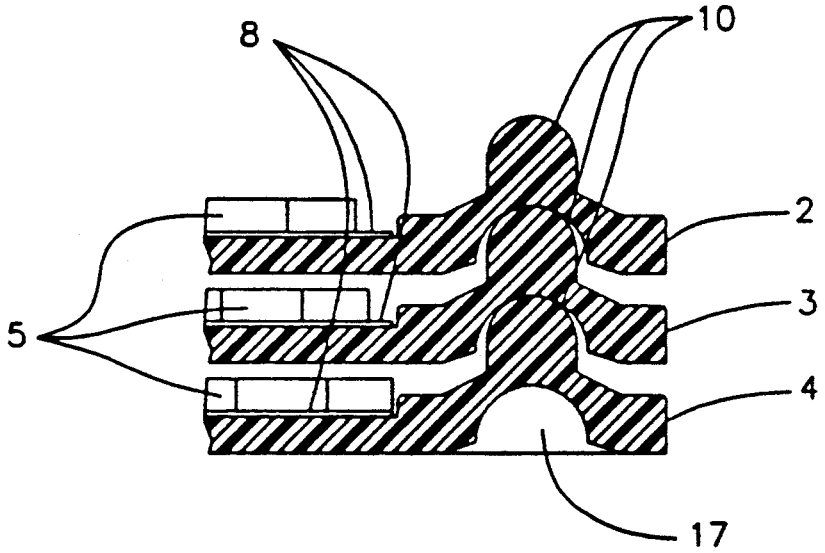
FIG. 15 is an enlarged, fragmentary, cross-sectional view of the corners of three trays as viewed along line 10—10 of FIG. 1, with the trays being oriented to provide a clearance between adjacent trays, as shown in FIGS. 11 and 12.

Referring to FIGS. 4, 11, 12 and 14, the jigsaw puzzle piece organizer 1 of the present invention comprises a plurality of identical trays 2, 3 and 4, adapted to be oriented relative to each other in one direction to provide a compact interconnected stack for non-use storage as shown in FIG. 4, or oriented in another direction to provide a clearance between adjacent trays as shown in FIGS. 11 and 12, each of which could be carrying puzzle pieces 5 as shown in FIGS. 14 and 15 for temporary storage. Three trays 2, 3 and 4 have been shown in the two different stacked positions for illustration purposes only, and it is to be understood that any selected number of trays can be used in the organizer, with the number of trays normally being determined by the size of the jigsaw puzzle.

The details of the construction of each tray are shown in FIGS. 1 to 3, and 6 to 8, wherein it will be seen that the tray is of rectangular configuration having a peripheral raised border 6 providing a recess 7 in the main body portion of the tray for supporting the puzzle pieces 5. The longitudinally extending sides of the border 6 are further provided with rounded edges 7 to provide handles to facilitate manipulating the trays.

A grid indicia 8 is provided on the supporting surface of the tray to facilitate the positioning of the various puzzle pieces 5 in columns and rows and according to color and/or shape on a respective tray. The grid 8 can be printed directly on the supporting surface of a tray or on a removable sheet of paper placed on the tray, as shown in the drawings. The grid 8 can also have light or dark colored backgrounds in order to contrast with the puzzle pieces 5.

Figure 1:
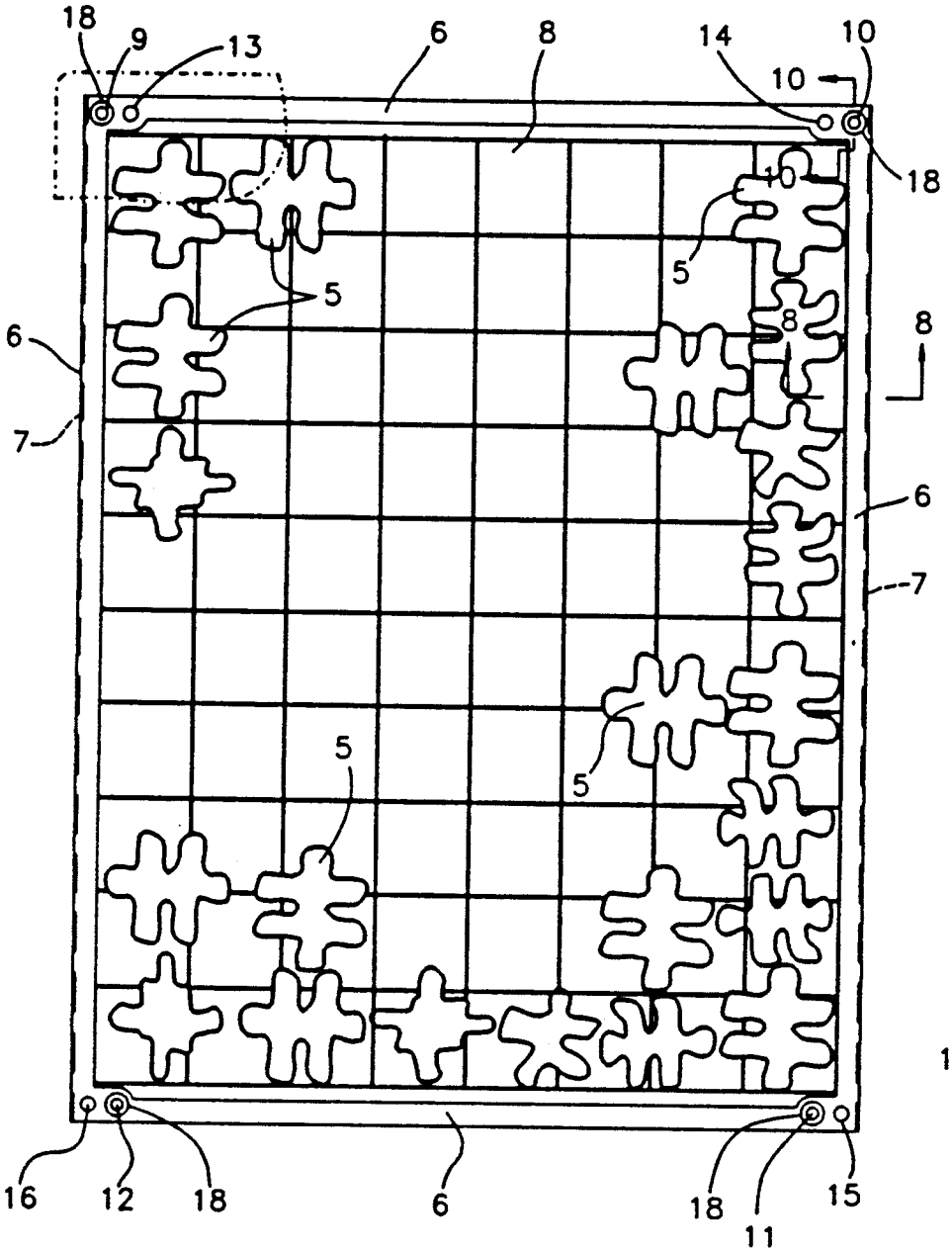
FIG. 1 is a top plan view of one of the trays employed in the organizer of the present invention.
Figure 2:
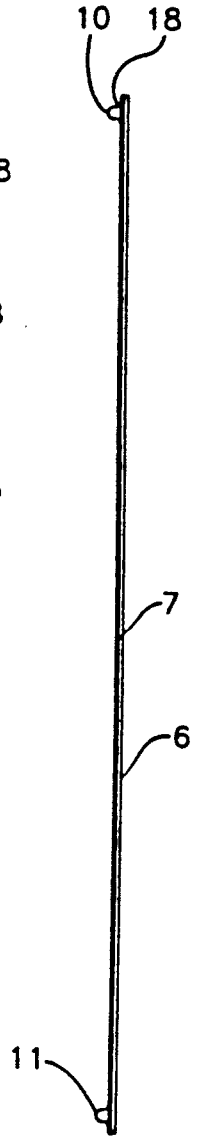
FIG. 2 is a side elevational view of the tray shown in FIG. 1.

Referring to FIG. 1, to facilitate the stacking of the trays 2, 3 and 4, the corners of each tray are provided with upstanding posts 9, 10, 11 and 12, and apertures 13, 14, 15 and 16. As will be seen in FIG. 1, the posts 9 and 10 at one end of the tray are outboard of the adjacent apertures 13 and 14, while the posts 11 and 12 at the opposite end of the tray are inboard of the adjacent apertures 15 and 16.

Figure 3:
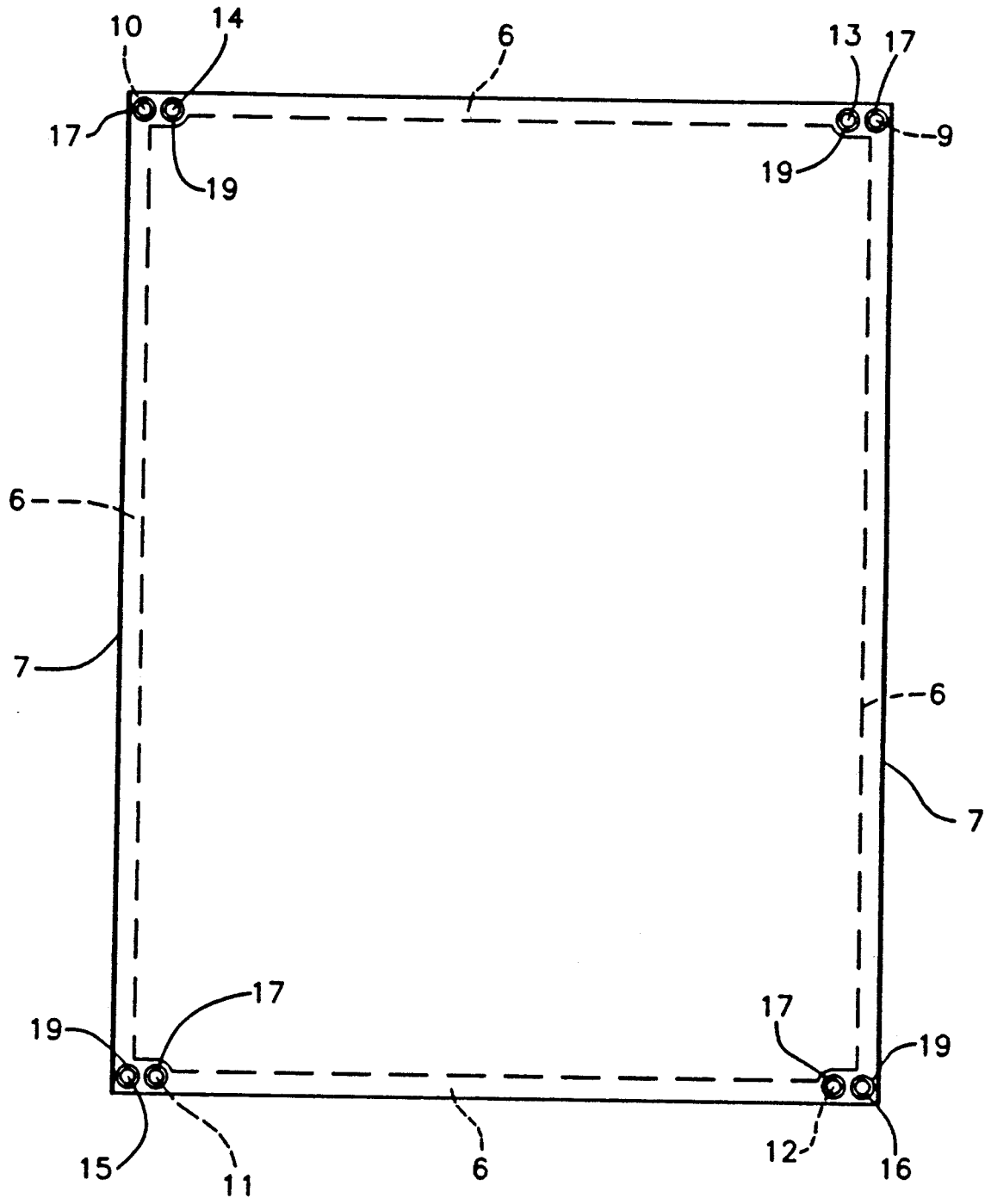
FIG. 3 is a bottom plan view of the tray shown in FIG. 1.
Figure 6:
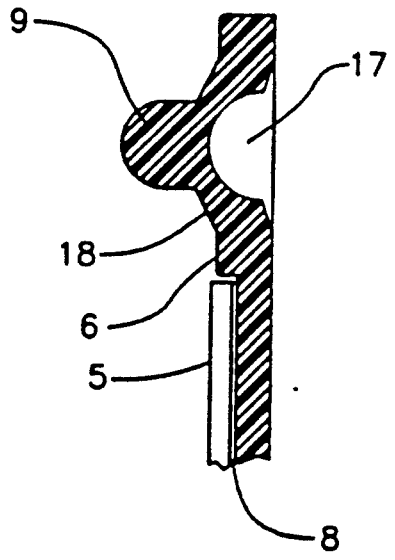
FIG. 6 is a cross-sectional view taken along line 6—6 of FIG. 5.
Figure 7:
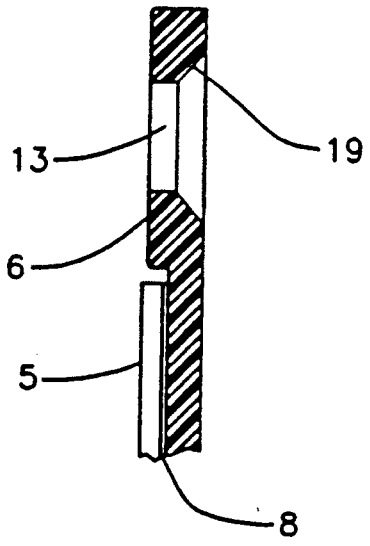
FIG. 7 is a cross-sectional view taken along line 7—7 of FIG. 5.
Figure 8:
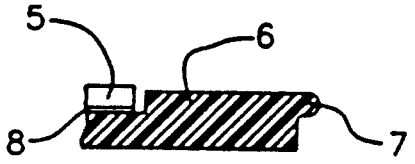
FIG. 8 is a cross-sectional view taken along line 8—8 of FIG. 1.

As will be seen in FIGS. 6 and 7, and the other views such as FIGS. 1 and 3, the bottom surface of the tray border 6 is formed with a spherical recess 17 configured to correspond to the spherical end of the posts 9, 10, 11 and 12, each of which is further provided with an annular skirt portion 18, on the top surface of the tray border 6, configured to correspond to a countersunk hole portion 19 formed around the periphery of the bottom of each of the apertures 13, 14, 15 and 16.

By the construction and arrangement of the posts 9, 10, 11 and 12 and the apertures 13, 14, 15 and 16, it is possible to orient adjacent trays relative to each other to provide a compact interconnected stack wherein there is no clearance between adjacent trays, as shown in FIG. 4, or to provide an interconnected stack wherein there is a clearance between adjacent trays, as shown in FIGS. 11 and 12.

Figure 9:
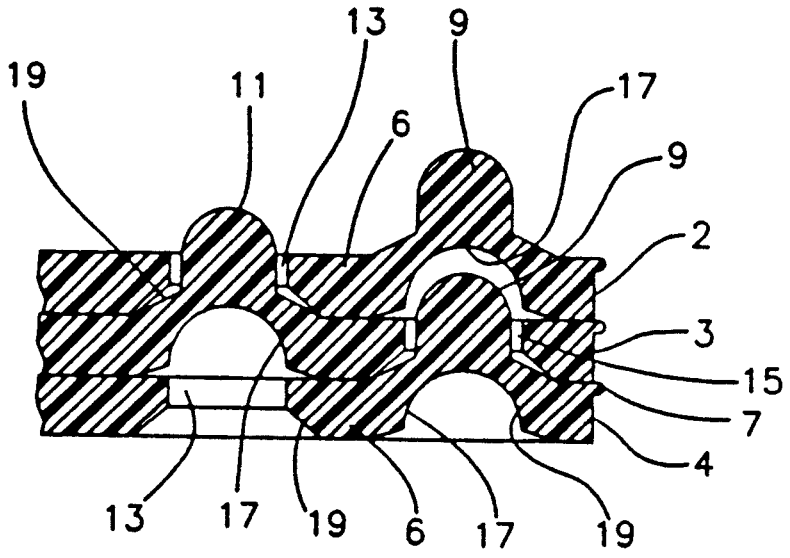
FIG. 9 is an enlarged, fragmentary, cross-sectional view of the corners of three trays as viewed along line 9—9 of FIG. 5 with the trays being oriented in a compact stack for non-use storage.
Figure 10:
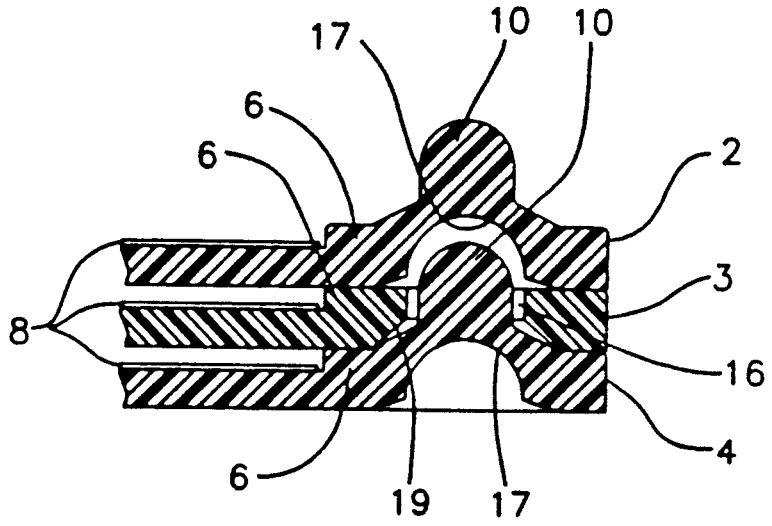
FIG. 10 is an enlarged, fragmentary, cross-sectional view of the corners of three trays as viewed along line 10—10 of FIG. 1, with the trays being oriented in a compact stack for non-use storage.

FIGS. 9 and 10 illustrate the relative positions of trays 2, 3 and 4 when the trays are arranged in a compact interconnected stack. To accomplish this, the middle tray 3 is oriented 180° relative to trays 2 and 4, so that the post 11 on tray 3 extends through aperture 13 in tray 2, and post 9 in tray 4 extends through aperture 15 in tray 3 and partly into spherical recess 17 of post 9 of tray 2; while at the other corner at the same end of the trays, post 10 on tray 4 extends through aperture 16 in tray 3 and partly into spherical recess 17 of post 10 of tray 2, and post 12 on tray 3, not shown, extends through aperture 14 in tray 2, not shown. The posts and apertures at the other corners of the trays at the opposite end, interconnect in the same manner. When so oriented, the peripheral borders 6 of the trays abut each other so that there is no substantial clearance between adjacent trays.

Figure 13:
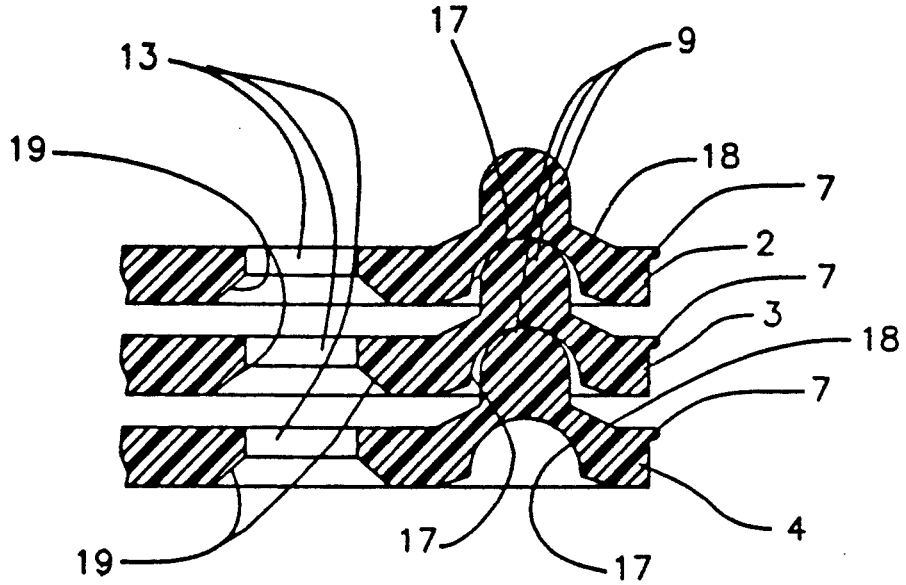
FIG. 13 is an enlarged, fragmentary, cross-sectional view of the corners of three trays as viewed along line 9—9 of FIG. 5 with the trays being oriented to provide a clearance between adjacent trays as shown in FIGS. 11 and 12.

To provide a stack of trays where a space is provided between adjacent trays, as shown in FIGS. 11–15, and referring particularly to FIGS. 13 and 15, the middle tray 3 is oriented so that the posts 9 and 10 are aligned with the corresponding posts in the adjacent trays, whereby each post becomes seated in the respective spherical recesses 17 of the next above adjacent tray. The posts 11 and 12 at the opposite end of each tray will be similarly aligned and seated in the respective spherical recesses. The depth of the recesses 17 is such to allow for a firm seating of the posts therein and to provide sufficient clearance between trays for puzzle pieces 5 or grids 8.

The trays are dimensioned to fit in a standard size puzzle box, approximately 9" by 12", and in use, the various puzzle pieces 5 are placed on the grid 8 in a respective tray 2, 3 and 4 in columns and rows, according to color and/or shape to facilitate the assembly of a jigsaw puzzle. If the puzzle is not completed in one sitting, the trays 2, 3 and 4 containing the remaining puzzle pieces 5 can be oriented to the stacked position shown in FIGS. 11, 12 and 14, whereby the puzzle pieces 5 are temporarily stacked until the puzzle is completed, whereupon the trays 2, 3, and 4 are oriented into a compact interconnected stack as shown in FIG. 4 for storage in the puzzle box.

From the above description it will be appreciated by those skilled in the art that the organizer of the present invention promotes the organization of loose puzzle pieces based on color and/or geometry, thereby facilitating the assembly of a jigsaw puzzle, while providing a temporary storage for the puzzle pieces until the completion of the puzzle.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A jigsaw puzzle piece organizer comprising a plurality of trays, each tray having a main body portion providing a surface for supporting a plurality of various colored and shaped puzzle pieces, connector means mounted on each tray, said connector means including a plurality of posts extending upwardly from the tray and a plurality of apertures extending through the tray, said apertures being positioned adjacent said posts, said connector means being constructed and arranged for selectively stacking said plurality of trays to provide a clearance between adjacent trays, or into a substantially no clearance compact stack, whereby when the trays are stacked to provide a clearance between adjacent trays, the end portions of the posts on one tray engage the bottom surface of the next adjacent tray, and when the trays are stacked into a substantially no clearance stack, the posts on one tray extend through the apertures in the next adjacent tray.

2. A jigsaw puzzle piece organizer according to claim 1, wherein each tray is rectangular, said posts and apertures being grouped in pairs and positioned on each end of said tray.

3. A jigsaw puzzle piece organizer according to claim 2, wherein the pair of posts on one end of the tray are positioned outboard of the adjacent pair of apertures, and the pair of posts on the other end of the tray are positioned inboard of the adjacent pair of apertures.

4. A jigsaw puzzle piece organizer according to claim 3, wherein to stack the trays into a substantially no-clearance stack, one tray is oriented 180° relative to the other tray so that the posts on one end of the tray extend through the apertures on the other end of the other tray.

5. A jigsaw puzzle piece organizer according to claim 1, wherein a spherical recess is provided in the bottom surface of each tray in alignment with a respective post, the posts on each tray extending into contact with said recesses when the trays are stacked to provide a clearance between adjacent trays.

6. A jigsaw puzzle piece organizer according to claim 4, wherein a spherical recess is provided in the bottom surface of each tray in alignment with a respective post, and said posts on one end of the tray extending through said apertures on the other end of the next adjacent tray, also extending partly into said recesses in the second adjacent tray.

* * * * *